US010149049B2

(12) United States Patent
Moghimi et al.

(10) Patent No.: US 10,149,049 B2
(45) Date of Patent: Dec. 4, 2018

(54) PROCESSING SPEECH FROM DISTRIBUTED MICROPHONES

(71) Applicant: Bose Corporation, Framingham, MA (US)

(72) Inventors: Amir Moghimi, Sutton, MA (US); David Crist, Watertown, MA (US); William Berardi, Grafton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/373,541

(22) Filed: Dec. 9, 2016

(65) Prior Publication Data

US 2017/0332168 A1 Nov. 16, 2017

Related U.S. Application Data

(60) Provisional application No. 62/335,981, filed on May 13, 2016.

(51) Int. Cl.

| | |
|---|---|
| ***H04R 3/00*** | (2006.01) |
| ***H04R 1/40*** | (2006.01) |
| ***G10L 21/0232*** | (2013.01) |
| ***G10L 21/0208*** | (2013.01) |
| *G10L 25/84* | (2013.01) |
| *G10L 21/0216* | (2013.01) |
| *H04R 1/10* | (2006.01) |

(52) U.S. Cl.

CPC ..... *H04R 3/005* (2013.01); *G10L 21/0208* (2013.01); *G10L 21/0232* (2013.01); *H04R 1/406* (2013.01); *G10L 25/84* (2013.01); *G10L 2021/02166* (2013.01); *H04R 1/1083* (2013.01); *H04R 2430/20* (2013.01)

(58) Field of Classification Search

CPC ..... H04R 3/005; H04R 1/406; H04R 1/326; H04R 3/12; G10L 21/0232; G10L 25/84; G10L 2021/02166; G10L 15/08; G10L 15/22; G10L 2015/088; G10L 25/51; G10L 2015/223; G10L 15/24; G10L 15/28; G10L 15/285; G10L 15/30; G10L 15/32; G10L 17/005; G10L 2015/228

USPC ... 381/17, 23.1, 77, 92, 94.1, 122, 311, 315; 455/66.1; 704/233

See application file for complete search history.

(56) References Cited

U.S. PATENT DOCUMENTS

2004/0131201 A1* 7/2004 Hundal ..... H04M 9/082 381/77

2009/0238377 A1 9/2009 Ramakrishnan et al.

(Continued)

OTHER PUBLICATIONS

The International Search Report and the Written Opinion of the International Searching Authority dated Jan. 2, 2018 for PCT Application No. PCT/US2017/053177.

*Primary Examiner* — Vivian Chin
*Assistant Examiner* — Friedrich W Fahnert
(74) *Attorney, Agent, or Firm* — Brian M. Dingman; Dingman IP Law, PC

(57) ABSTRACT

A system with a plurality of microphones positioned at different locations, and a modification system in communication with the microphones. The modification system is configured to derive a plurality of audio signals from the plurality of microphones, compute a confidence score for each derived audio signal, and based on the computed confidence scores, use one derived audio signal to modify another audio signal.

22 Claims, 2 Drawing Sheets

(56) References Cited

U.S. PATENT DOCUMENTS

| | | | | |
|---|---|---|---|---|
| 2010/0184383 | A1* | 7/2010 | Lerke | H04R 25/552 455/66.1 |
| 2014/0003636 | A1* | 1/2014 | Bodvarsson | H04R 25/552 381/311 |
| 2014/0278394 | A1 | 9/2014 | Bastyr et al. | |
| 2014/0301558 | A1 | 10/2014 | Fan | |
| 2015/0124976 | A1* | 5/2015 | Pedersen | H04R 25/552 381/23.1 |
| 2015/0289065 | A1* | 10/2015 | Jensen | H04R 25/552 381/315 |
| 2016/0099008 | A1* | 4/2016 | Barker | H04R 25/505 704/233 |
| 2017/0011753 | A1* | 1/2017 | Herbig | H04R 3/00 |
| 2017/0099550 | A1* | 4/2017 | Blessing | H04R 25/50 |

* cited by examiner

PROCESSING SPEECH FROM DISTRIBUTED MICROPHONES

CROSS REFERENCE TO RELATED APPLICATION

This application claims priority to Provisional Application No. 62/335,981, filed on May 13, 2016, the disclosure of which is incorporated herein by reference.

BACKGROUND

This disclosure relates to processing speech from distributed microphones.

Current speech recognition systems assume one microphone or microphone array is listening to a user speak and taking action based on the speech. The action may include local speech recognition and response, cloud-based recognition and response, or a combination of these. In some cases, a "wake-up word" is identified locally, and further processing is provided remotely based on the wake-up word.

Distributed speaker systems may coordinate the playback of audio at multiple speakers, located around a home, so that the sound playback is synchronized between locations.

SUMMARY

In general, in one aspect, a system includes a plurality of microphones positioned at different locations, and a dispatch system in communication with the microphones. The dispatch system derives a plurality of audio signals from the plurality of microphones, computes a confidence score for each derived audio signal, and compares the computed confidence scores. Based on the comparison, the dispatch system selects at least one of the derived audio signals for further handling.

Implementations may include one or more of the following, in any combination. The dispatch system may include a plurality of local processors each connected to at least one of the microphones. The dispatch system may include at least a first local processor and at least a second processor available to the first processor over a network. Computing the confidence score for each derived audio signal may include computing a confidence in one or more of whether the signal may include speech, whether a wakeup word may be included in the signal, what wakeup word may be included in the signal, a quality of speech contained in the signal, an identity of a user whose voice may be recorded in the signal, and a location of the user relative to the microphone locations. Computing the confidence score for each derived audio signal may also include determining that the audio signal appears to contain an utterance and whether the utterance includes a wakeup word. Computing the confidence score for each derived audio signal may also include identifying which wakeup word from a plurality of wakeup words is included in the speech. Computing the confidence score for each derived audio signal further may include determining a degree of confidence that the speech includes the wakeup word.

Computing the confidence score for each derived audio signal may include comparing one or more of a timing between when the microphones detected sounds corresponding to each of the audio signals, signal strength of the derived audio signals, signal-to-noise ratio of the derived audio signals, spectral content of the derived audio signals, and reverberation within the derived audio signals. Computing the confidence score for each derived audio signal may include, for each audio signal, computing a distance between an apparent source of the audio signal and at least one of the microphones. Computing the confidence score for each derived audio signal may include computing a location of the source of each audio signal relative to the locations of the microphones. Computing the location of the source of each audio signal may include triangulating the location based on computed distances distance between each source and at least two of the microphones.

The dispatch system may transmit at least a portion of the selected signal or signals to a speech processing system to provide the further handling. Transmitting the selected audio signal or signals may include selecting at least one speech processing system from a plurality of speech processing systems. At least one speech processing system of the plurality of speech processing systems may include a speech recognition service provided over a wide-area network. At least one speech processing system of the plurality of speech processing systems may include a speech recognition process executing on the same processor on which the dispatch system is executing. The selection of the speech processing system may be based on one or more of preferences associated with a user, the computed confidence scores, or context in which the audio signals are derived. The context may include one or more of an identification of a user that may be speaking, which microphones of the plurality of microphones produced the selected derived audio signals, a location of the user relative to the microphone locations, operating state of other devices in the system, and time of day. The selection of the speech processing system may be based on resources available to the speech processing systems.

Comparing the computed confidence scores may include determining that at least two selected audio signals appear to contain utterances from at least two different users. The determining that the selected audio signals appear to contain utterances from at least two different users may be based on one or more of voice identification, location of the users relative to the locations of the microphones, which of the microphones produced each of the selected audio signals, use of different wakeup words in the two selected audio signals and visual identification of the users. The dispatch system may also send the selected audio signals corresponding to the two different users to two different selected speech processing systems. The selected audio signals may be assigned to the selected speech processing systems based on one or more of preferences of the users, load balancing of the speech processing systems, context of the selected audio signals, and use of different wakeup words in the two selected audio signals. The dispatch system may also send the selected audio signals corresponding to the two different users to the same speech processing system as two separate processing requests.

Comparing the computed confidence scores may include determining that at least two received audio signals appear to represent the same utterance. The determining that the selected audio signals represent the same utterance may be based on one or more of voice identification, location of the source of the audio signals relative to the locations of the microphones, which of the microphones produced each of the selected audio signals, time of arrival of the audio signals, correlations between the audio signals or between outputs of microphone array elements, pattern matching, and visual identification of the person speaking. The dispatch system may also send only one of the audio signals appearing to represent the same utterance to the speech processing system. The dispatch system may also send both of the audio signals appearing to represent the same utterance to the speech processing system. The dispatch system may also transmit at least one selected audio signal to each of at least two speech processing systems, receive responses from each of the speech processing systems, and determine an order in which to output the responses.

The dispatch system may also transmit at least two selected audio signals to at least one speech processing system, receive responses from the speech processing system corresponding to each of the transmitted signals, and determine an order in which to output the responses. The dispatch system may be further configured to receive a response to the further processing, and output the response using an output device. The output device may not correspond to the microphone that captured the audio. The output device may not be located at any of the locations where the microphones are located. The output device may include one or more of a loudspeaker, headphones, a wearable audio device, a display, a video screen, or an appliance. Upon receiving multiple responses to the further processing, the dispatch system may determine an order in which to output the responses by combining the responses into a single output. Upon receiving multiple responses to the further processing, the dispatch system may determine an order in which to output the responses by selecting fewer than all of the responses to output, or sending different responses to different output devices. The number of derived audio signals may be not equal to the number of microphones. At least one of the microphones may include a microphone array. The system may also include non-audio input devices. The non-audio input devices may include one or more of accelerometers, presence detectors, cameras, wearable sensors, or user interface devices.

In general, in one aspect, a system includes a plurality of devices positioned at different locations, and a dispatch system in communication with the devices receives a response from a speech processing system in response to a previously-communicated request, determines a relevance of the response to each of the devices, and forwards the response to at least one of the devices based on the determination.

Implementations may include one or more of the following, in any combination. The at least one of the devices may include an audio output device, and forwarding the response may cause that device to output audio signals corresponding to the response. The audio output device may include one or more of a loudspeaker, headphones, or a wearable audio device. The at least one of the devices may include a display, a video screen, or an appliance. The previously-communicated request may have been communicated from a third location not associated with any of the plurality of locations of the devices. The response may be a first response, and the dispatch system may also receive a response from a second speech processing system. The dispatch system may also forward the first response to a first one of the devices, and forward the second response to a second one of the devices. The dispatch system may also forward both the first response and the second response to a first one of the devices. The dispatch system may also forward only one of the first response and the second response to any of the devices.

Determining the relevance of the response may include determining which of the devices were associated with the previously-communicated request. Determining the relevance of the response may include determining which of the devices may be closest to a user associated with the previously-communicated request. Determining the relevance of the response may be based on preferences associated with a user of the claimed system. Determining the relevance of the response may include determining a context of the previously-communicated request. The context may include one or more of an identification of a user that may have been associated with the request, which microphone of a plurality of microphones may have been associated with the request, a location of the user relative to the device locations, operating state of other devices in the system, and time of day. Determining the relevance of the response may include determining capabilities or resource availability of the devices.

A plurality of output devices may be positioned at different output device locations, and the dispatch system may also receive a response from the speech processing system in response to the transmitted request, determine a relevance of the response to each of the output devices, and forward the response to at least one of the output devices based on the determination. The at least one the output devices may include an audio output device, and forwarding the response causes that device to output audio signals corresponding to the response. The audio output device may include one or more of a loudspeaker, headphones, or a wearable audio device. The at least one of the output devices may include a display, a video screen, or an appliance. Determining the relevance of the response may include determining a relationship between the output devices and the microphones associated with the selected audio signals. Determining the relevance of the response may include determining which of the output devices may be closest to a source of the selected audio signal. Determining the relevance of the response may include determining a context in which the audio signals were derived. The context may include one or more of an identification of a user that may have been speaking, which microphone of the plurality of microphones produced the selected derived audio signals, a location of the user relative to the microphone locations and the device locations, operating state of other devices in the system, and time of day. Determining the relevance of the response may include determining capabilities or resource availability of the output devices.

In general, in one aspect, a system includes a plurality of microphones positioned at different microphone locations, a plurality of loudspeakers positioned at different loudspeaker locations, and a dispatch system in communication with the microphones and loudspeakers. The dispatch system derives a plurality of voice signals from the plurality of microphones, computes a confidence score about the inclusion of a wakeup word for each derived voice signal, compares the computed confidence scores, and based on the comparison, selects at least one of the derived voice signals and transmits at least a portion of the selected signal or signals to a speech processing system. The dispatch system receives a response from a speech processing system in response to the transmission, determines a relevance of the response to each of the loudspeakers, and forwards the response to at least one of the loudspeakers for output based on the determination.

In general, in another aspect a system includes a plurality of microphones positioned at different locations, and a modification system in communication with the microphones. The modification system is configured to derive a plurality of audio signals from the plurality of microphones, compute a confidence score for each derived audio signal, and based on the computed confidence scores, use one derived audio signal to modify another audio signal.

Computing a confidence score for each derived audio signal may comprise computing a confidence in whether the derived audio signal comprises speech and whether the derived audio signal comprises non-speech sound. Computing a confidence score for each derived audio signal may comprise determining if the derived audio signal is a speech signal. Using one derived audio signal to modify another audio signal may comprise filtering a first audio signal with a second audio signal. Filtering a first audio signal with a second audio signal may comprise using the second audio signal as a reference to an adaptive filter for the first audio signal. The number of derived audio signals may be different than the number of microphones.

At least one of the microphones may comprise a microphone array. A first microphone array may be spatially focused on a first sound target. A second microphone array may be spatially focused on a second sound target. The first sound target may comprise a human voice. The second sound target may comprise a noise source.

A first microphone may be part of a first device and a second microphone may be part of a second device, and a first audio signal may be derived from the first microphone and a second audio signal may be derived from the second microphone. The second device may transmit the second audio signal to the first device. The first device may use the second audio signal to modify the first audio signal. The first device may use the second audio signal to reduce noise in the first audio signal.

A first and a second microphone may both be part of a first device. A first audio signal may be derived from the first microphone and a second audio signal may be derived from the second microphone. The second audio signal may be used to reduce noise in the first audio signal. The plurality of microphones may be part of a first device. The first device may spatially focus a plurality of its microphones on first and second separate sound sources, where a first audio signal is derived from the first sound source and a second audio signal is derived from the second sound source. The second audio signal may be used to reduce noise in the first audio signal.

In general, in another aspect a system includes a plurality of microphones positioned at different locations, wherein a first microphone is part of a first device and a second microphone is part of a second device, wherein the first device is operated to derive a first audio signal from the first microphone, the second device is operated to derive a second audio signal from the second microphone, and the second device is adapted to transmit the second audio signal to the first device. A modification system that is part of the first device is responsive to the first and second audio signals, wherein the modification system uses the second audio signal to reduce noise in the first audio signal.

In general, in another aspect a system includes a plurality of microphones that are part of a first device, including first and second microphones, wherein the first device is operated to derive a first audio signal from the first microphone and a second audio signal from the second microphone. A modification system is part of the first device and is responsive to the first and second audio signals, wherein the modification system uses the second audio signal to reduce noise in the first audio signal.

In general, in another aspect a system includes a plurality of microphones that are part of a first device, wherein the first device spatially focuses a plurality of its microphones on first and second separate sound sources, where a first audio signal is derived from the first sound source and a second audio signal is derived from the second sound source. The first device is operated to derive a first audio signal from the first sound source and a second audio signal from the second sound source. A modification system is part of the first device and is responsive to the first and second audio signals, wherein the modification system uses the second audio signal to reduce noise in the first audio signal.

Advantages include detecting a spoken command at multiple locations and providing a single response to the command. Advantages also include providing a response to a spoken command at a location more relevant to the user than the location where the command was detected.

All examples and features mentioned above can be combined in any technically possible way. Other features and advantages will be apparent from the description and the claims.

DESCRIPTION

As more and more devices implement voice-controlled user interfaces (VUIs), a problem arises that multiple devices may detect the same spoken command and attempt to handle it, resulting in problems ranging from redundant responses to contradictory actions being taken at different points of action. Similarly, if a spoken command can result in output or action by multiple devices, which device should take action may be ambiguous. In some VUIs, a special phrase, referred to as a "wakeup word," "wake word," or "keyword" is used to activate the speech recognition features of the VUI—the device implementing the VUI is always listening for the wakeup word, and when it hears it, it parses whatever spoken commands came after it. This is done to conserve processing resources, by not parsing every sound that is detected, and can help disambiguate which system was the target of the command, but if multiple systems are listening for the same wakeup word, such as because the wakeup word is associated with a service provider and not individual pieces of hardware, the problem remains of determine which device should handle the command.

Figure 1:
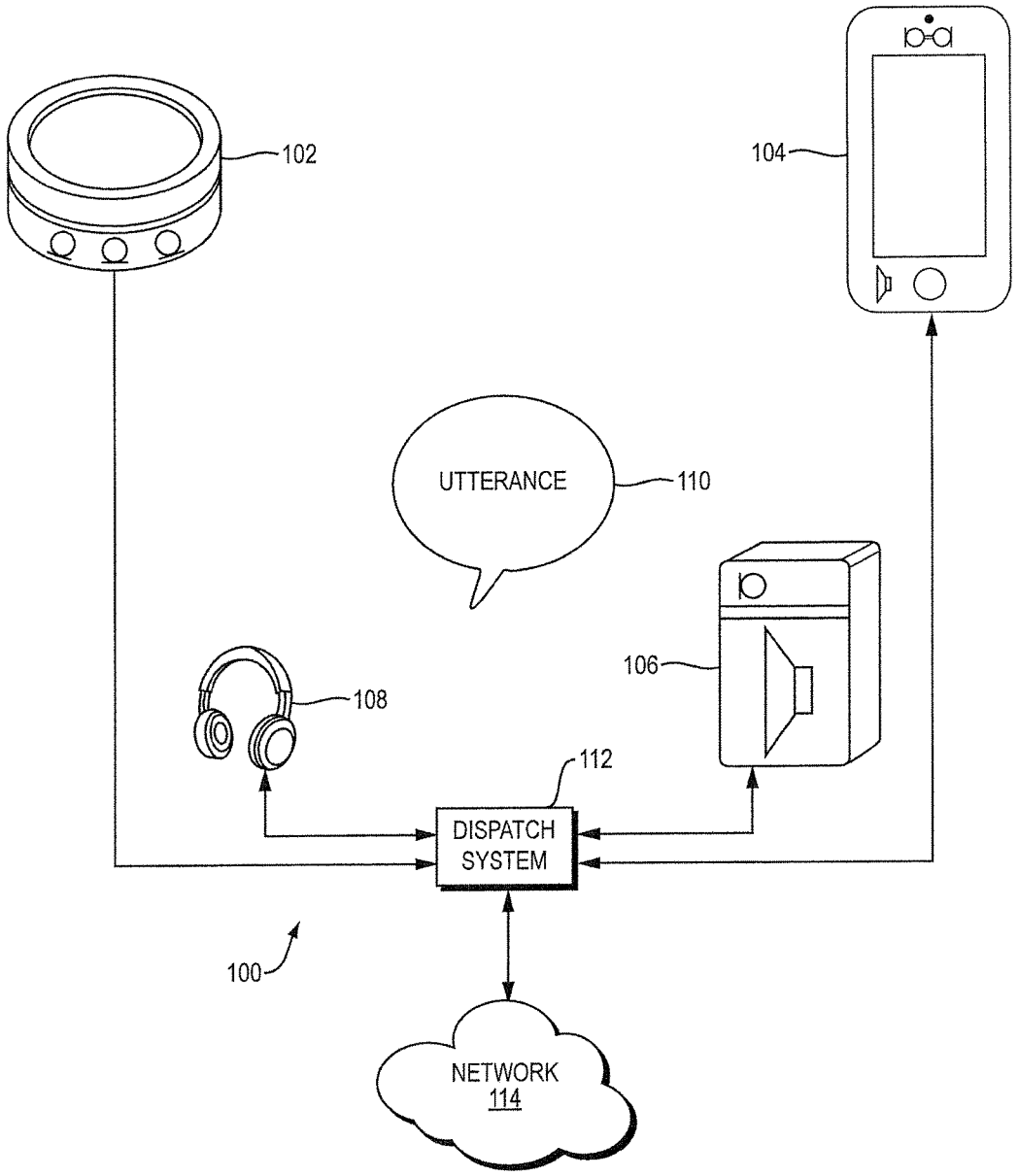
FIG. 1 shows a system layout of microphones and devices that may respond to voice commands received by the microphones.

FIG. 1 shows an exemplary system 100 in which one or more of a stand-alone microphone array 102, a smart phone 104, a loudspeaker 106, and a set of headphones 108 each have microphones that detect a user's speech (to avoid confusion, we refer to the person speaking as the "user" and the device 106 as a "loudspeaker;" discrete things spoken by the user are "utterances"). Also, "sound," "noise," and similar words refer to audible acoustic energy. An "audio signal" refers to an electrical or optical signal that represents such a sound, and which may be generated by a microphone or other electronics, and may be converted back into audible acoustic energy by a loudspeaker. Each of the devices that detects the utterance 110 transmits what it heard as an audio signal to a dispatch system 112. In the case of the devices having multiple microphones, those devices may combine the signals rendered by the individual microphones to render a single combined audio signal, or they may transmit a signal rendered by each microphone.

The dispatch system 112 maybe a cloud-based service to which each of the devices is individually connected, a local service running on one of the same devices or an associated device, a distributed service running cooperatively on some or all of the devices themselves, or any combination of these or similar architectures. Due to their different microphone designs and their differing proximity to the user, each of the devices may hear the utterance 110 differently, if at all. For example, the stand-alone microphone array 102 may have a high-quality beam-forming capability that allows it to clearly hear the utterance regardless of where the user is, while the headphones 108 and the smart phone 104 have highly directional near-field microphones that only clearly pick up the user's voice if the user is wearing the headphones and holding the phone up to their face, respectively. Meanwhile, the loudspeaker 106 may have a simple omni-directional microphone that detects the speech well if the user is close to and facing the loudspeaker, but produces a low-quality signal otherwise.

Based on these and similar factors, the dispatch system 112 computes a confidence score for each audio signal (this may include the devices themselves scoring their own detection before sending what they heard, and sending that score along with their respective audio signals). Based on a comparison of the confidence scores, to each other and/or to a baseline, the dispatch system 112 selects one or more of the audio signals for further processing. This may include locally performing speech recognition and taking direct action, or transmitting the audio signal over a network 114, such as the Internet or any private network, to another service provider. For example, if one of the devices produces an audio signal with a high confidence that the signal contains the wakeup word "OK Google", that audio signal may be sent to Google's cloud-based speech recognition system for handling. In the case that the audio signal is transmitted to a remote service, the wakeup word may be included along with whatever utterance followed it, or the utterance alone may be sent.

The confidence scoring may be based on a large number of factors, and may indicate confidence in more than one parameter as well. For example, the score may indicate a degree of confidence about which wakeup word was used (and/or whether one was used at all), or where the user was located relative to the microphone. The score may also indicate a degree of confidence in whether the audio signal is of high quality. In one example, the dispatch system may score the audio signals from two devices as both having a high confidence score that a particular wakeup word was used, but score one of them with a low confidence in the quality of the audio signal, while the other is scored with a high confidence in the audio signal quality. The audio signal with the high confidence score for signal quality would be selected for further processing.

When more than one device transmits an audio signal, one of the critical things to determine confidence in is whether the audio signals represent the same utterance or two (or more) different utterances. The scoring itself may be based on such factors as signal level, signal-to-noise ratio (SNR), amount of reverberation in the signal, spectral content of the signal, user identification, knowledge about the user's location relative to the microphones, or relative timing of the audio signals at two or more of the devices. Location-related scoring and user identity-related scoring may be based on both the audio signals themselves and on external data such as visual systems, wearable trackers worn by users, and identity of the devices providing the signals. For example, if a smart phone is the source of the audio signal, a confidence score that the owner of that smart phone is the user whose voice was heard would be high. User location may be determined based on the strength and timing of audio signals received at multiple locations, or at multiple microphones in an array at a single location.

In addition to determining which wakeup word was used and which signal is best, the scoring may provide additional context that informs how the audio signal should be handled. For example, if the confidence scores indicate that the user was facing the loudspeaker, than it may be that a VUI associated with the loudspeaker should be used, over one associated with the smart phone. Context may include such things as which user was speaking, where the user was located and facing relative to the devices, what activity was the user engaged in (e.g., exercising, cooking, watching TV), what time of day it is, or what other devices are in use (including devices other than those providing the audio signals).

In some cases, the scoring indicates that more than one command was heard. For example, two devices may each have high confidence that they heard different wakeup words, or that they heard different users speaking. In that case, the dispatch system may send two requests—one request to each system for which a wakeup word was used, or two different requests to a single system that both users invoked. In other cases, more than one of the audio signals may be sent—for example, to get more than one response, to let the remote system decide which one to use, or to improve the voice recognition by combining the signals. In addition to selecting an audio signal for further handling, the scoring may also lead to other user feedback. For example, a light may be flashed on whichever device was selected, so that the user knows the command was received.

Similar considerations come into play when a response is received from whatever service or system the dispatch system sent the audio signal to for handling. In many cases, the context around the utterance will also inform the handling of the response. For example, the response may be sent to the device from which the selected audio signal was received. In other cases, the response may be sent to a different device. For example, if the audio signal from the stand-alone microphone array 102 was selected, but the response back from the VUI is to start playing an audio file, the response should be handled by the headphones 108 or the loudspeaker 106. If the response is to display information, the smart phone 104 or some other device with a screen would be used to deliver the response. If the microphone array audio signal was selected because the scoring indicated that it had the best signal quality, additional scoring may have indicated that the user was not using the headphones 108 but was in the same room as the loudspeaker 106, so the loudspeaker is the likely target for the response. Other capabilities of the devices would also be considered—for example, while only audio devices are shown, voice commands could address other systems, such as lighting or home automation systems. Hence, if the response to the utterance is to turn down lights, the dispatch system may conclude that it is referring to the lights in the room where the strongest audio signal was detected. Other potential output devices include displays, screens (e.g., the screen on the smart phone, or a television monitor), appliances, door locks, and the like. In some examples, the context is provided to the remote system, and the remote system specifically targets a particular output device based on a combination of the utterance and the context.

As mentioned, the dispatch system may be a single computer or a distributed system. The speech processing provided may similarly be provided by a single computer or a distributed system, coextensive with or separate from the dispatch system. They each may be located entirely locally to the devices, entirely in the cloud, or split between both. They may be integrated into one or all of the devices. The various tasks described—scoring signals, detecting wakeup words, sending a signal to another system for handling, parsing the signal for a command, handling the command, generating a response, determining which device should handle the response, etc., may be combined together or broken down into more sub-tasks. Each of the tasks and sub-tasks may be performed by a different device or combination of devices, locally or in a cloud-based or other remote system.

When we refer to microphones, we include microphone arrays without any intended restriction on particular microphone technology, topology, or signal processing. Similarly, references to loudspeakers and headphones should be understood to include any audio output devices—televisions, home theater systems, doorbells, wearable speakers, etc.

Figure 2:
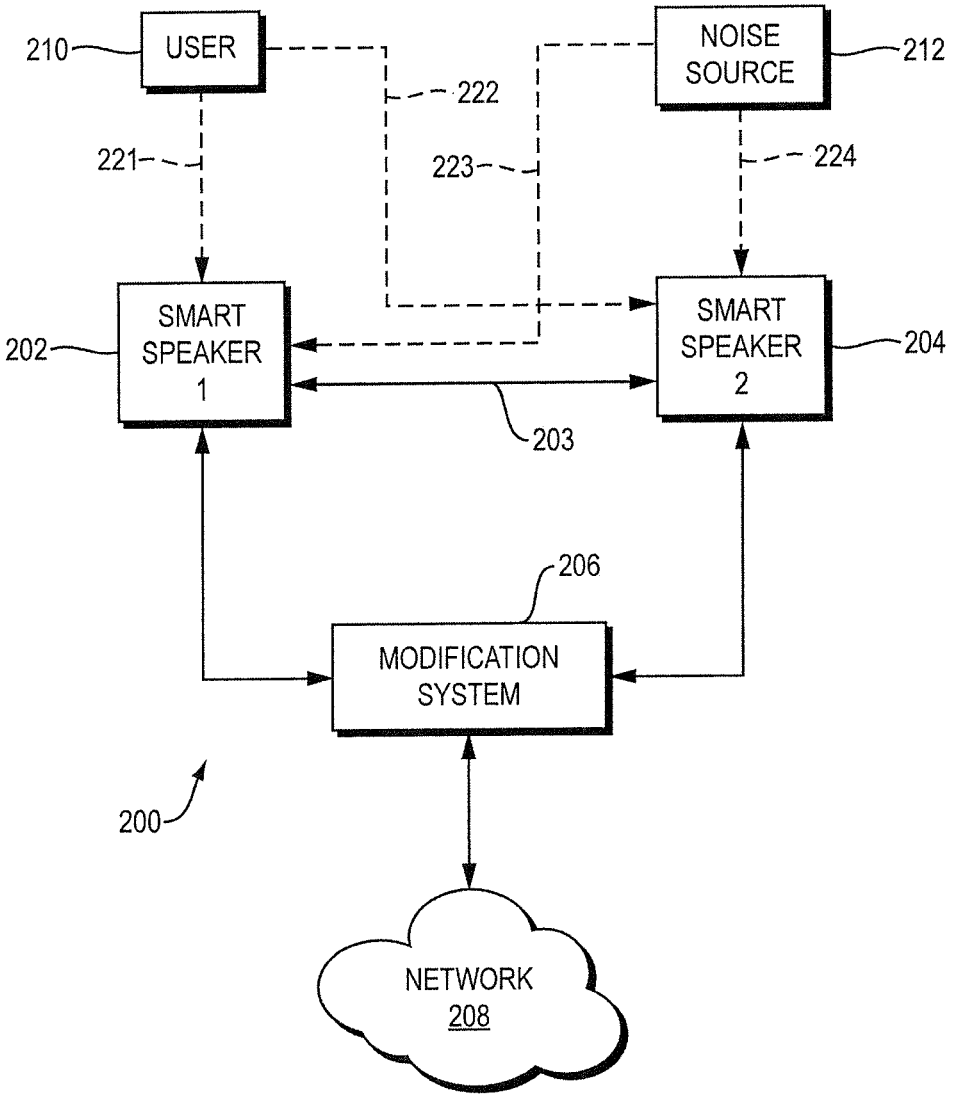
FIG. 2 illustrates a system that can use one audio signal to modify another audio signal.

FIG. 2 shows a second exemplary system 200 with smart speaker 1 (202) and smart speaker 2 (204). A smart speaker is a type of intelligent personal assistant that includes one or more microphones and one or more speakers, and has processing and communications capabilities. An example of a smart speaker is the Amazon Echo. Devices 202 and 204 could alternatively be devices that do not function as "smart speakers" but still have one or more microphones, processing capability, and communication capability. Examples of such alternative devices can include portable wireless speakers such as Bose SoundLink® wireless speaker. In some examples, two or more devices in combination, such as an Amazon Echo Dot and a Bose SoundLink® speaker provide the smart speaker. System 200 also includes modification system 206. Modification system 206 is configured to derive (or, receive) a plurality of audio signals from input signals from microphones in device 202 and/or device 204. Modification system 206 is also configured to compute a confidence score for each derived audio signal and, based on the confidence scores, use one audio signal to modify another audio signal. The functionality of modification system 206 can be part of one or both of devices 202 and 204, and/or it can be part of a separate device that can communicate with devices 202 and 204, and/or it can be a cloud-based device or service. Cloud-based aspects are indicated by network 208. As indicated by line 203, devices 202 and 204 can communicate with each other. In a home environment, this communication would typically (but not necessarily) be wireless, e.g., via Wi-Fi using a router. An alternative is direct wireless or wired communication using, for example, Bluetooth or a LAN.

One or more microphones of each of devices 202 and 204 detect sound from user 210 (an utterance) and/or noise source 212. Typically, a first device picks up user utterances more strongly than the other device, while the other device picks up noise more strongly than the first device. There are many manners in which the audio signals from devices 202 and 204 can be processed so as to compute a confidence that the signal is based on or includes an utterance or not, and whether the signal is based on or includes undesired sound (termed generally herein "noise") or not. One such manner is to use a voice activity detector (VAD) in each of devices 202 and 204. A VAD is able to distinguish if sound is an utterance or not. In cases where system 200 is being used to reduce the noise content of an audio signal that includes an utterance, audio signals that that are based on received sound that does not trigger the VAD can be considered to be undesired noise, while audio signals that that are based on received sound that does trigger the VAD can be considered to be (or at least, to include) desired utterances.

As indicated by dashed lines 221-224, in this non-limiting example device 202 is closer to user 210 than it is to noise source 212, and device 204 is closer to noise source 212 than it is to user 210. The system may include the ability to determine if a device is closer to a desired sound source (e.g., a user) or to an undesired sound source (e.g., a source of noise). Modification system 206 may accomplish this determination. As described above, the determination can be made in any technologically feasible manner, such as by comparing the timing between when microphones detect the sounds, or by comparing the signal strength of derived audio signals, or by comparing the signal-to-noise ratio of the derived audio signals, or by comparing the spectral content of the derived audio signals, or by comparing reverberation within the derived audio signals. In one example, in many cases device 202 will pick up utterances from user 210 more strongly than it will sound from noise source 212 (since it is closer to user 210), while the opposite is true for device 204. In this case, modification system 206 can determine that device 202 is closer to user 210, and device 212 is closer to noise source 212. Modification system 206 may compute a distance between sound sources 210 and/or 212 and devices 202 and/or 204. Modification system 206 may compute the location of sound sources 210 and/or 212. The location can, in one non-limiting example, be triangulated.

The quality of the audio signal that includes the desired sound (the utterance) can be improved by using the derived audio signal from the noise source to modify the derived audio signal from the source that most strongly received the utterance. So, the audio signal that is derived from device 204 (which picks up noise source 212 most strongly) is used to modify the audio signal that is derived from device 202 (which picks up user 210 utterance most strongly). Signal quality improvement can be accomplished by using modification system 206 to filter the voice-based audio signal with the noise-based audio signal. For example, an audio stream from device 204 can be used as a reference to an adaptive filter for the audio stream from device 202, to further reduce the noise that device 202 received from noise source 212. Adaptive filtering of audio signals is known in the art and so will not be further described herein.

In an example, devices 202 and 204 may be in different locations in a common area, such as a room in a home or a business conference room, for example. In one case, a common area can be thought of as any area in which devices 202 and 204 both pick up some sound from noise source 212. When devices 202 and 204 are smart speakers, or other devices that include one or more microphones and processing and communications capabilities, user 210 may be speaking commands that are meant for one or both of devices 202 and 204. At the same time there may be a television or refrigerator running, or perhaps one of devices 202 and 204 is playing music. Any such non-voice sound (termed "noise") can interfere with proper reception and use of a voice command. Thus, reducing noise in the desired signal (the one with the utterance/voice command) helps improve the functionality of the smart speaker or other device that most strongly received the utterance.

The multiple (two or more) microphones at different locations can comprise one or more microphones of two or more different devices (e.g., two devices each with one or multiple microphones), or can comprise multiple microphones of a single device. In the first instance, multiple microphones of each device can be spatially focused on the desired sound source (either the user or the noise source), e.g., by beamforming. When a single device includes the multiple microphones that are used, beamforming can be used to point a beam at the noise source and a different beam at the target source (the user). These beams cab be sequential when the same microphones are used for both beams, or can be in parallel if the device has a sufficient quantity of microphones.

In the case illustrated in FIG. 2, devices 202 and 204 are each able to wirelessly communicate with each other and with modification system 206. In many cases, system 206 will be accomplished using the processing of one of devices 202 or 204, so there is no separate device that includes system 206. Another alternative is to accomplish system 206 in a remote device, e.g., in the cloud 208. In one scenario, device 204 which picks up noise streams its processed audio signal to device 202. Device 202 then uses the incoming noise-based audio stream as a reference in an adaptive filter, to reduce the noise content of the audio signal from device 202. That includes the desired utterance.

Embodiments of the systems and methods described above comprise computer components and computer-implemented steps that will be apparent to those skilled in the art. For example, it should be understood by one of skill in the art that instructions for executing the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. A system, comprising:

a plurality of microphones positioned at different locations; and a modification system in communication with the microphones and configured to:

derive a plurality of audio signals from the plurality of microphones, compute a confidence score for each derived audio signal, and based on the computed confidence scores, use one derived audio signal to modify another audio signal, wherein using one derived audio signal to modify another audio signal comprises filtering a first audio signal with a second audio signal, and wherein filtering a first audio signal with a second audio signal comprises using the second audio signal as a reference to an adaptive filter for the first audio signal.

2. The system of claim 1, wherein computing a confidence score for each derived audio signal comprises computing a confidence in whether the derived audio signal comprises speech and whether the derived audio signal comprises non-speech sound.

3. The system of claim 1, wherein computing a confidence score for each derived audio signal comprises determining if the derived audio signal is a speech signal.

4. The system of claim 1, wherein the number of derived audio signals is not equal to the number of microphones.

5. The system of claim 1, wherein at least one of the microphones comprises a microphone array.

6. The system of claim 5, wherein a first microphone array is spatially focused on a first sound target.

7. The system of claim 6, wherein a second microphone array is spatially focused on a second sound target.

8. The system of claim 7, wherein the first sound target comprises a human voice.

9. The system of claim 8, wherein the second sound target comprises a noise source.

10. The system of claim 1, wherein a first microphone is part of a first device and a second microphone is part of a second device, and wherein a first audio signal is derived from the first microphone and a second audio signal is derived from the second microphone.

11. The system of claim 10, wherein the second device transmits the second audio signal to the first device.

12. The system of claim 11, wherein the first device uses the second audio signal to modify the first audio signal.

13. The system of claim 12, wherein the first device uses the second audio signal to reduce noise in the first audio signal.

14. The system of claim 1, wherein a first and a second microphone are both part of a first device.

15. The system of claim 14, wherein a first audio signal is derived from the first microphone and a second audio signal is derived from the second microphone.

16. The system of claim 15, wherein the second audio signal is used to reduce noise in the first audio signal.

17. The system of claim 1, wherein the plurality of microphones are part of a first device.

18. The system of claim 17, wherein the first device spatially focuses a plurality of its microphones on first and second separate sound sources, where a first audio signal is derived from the first sound source and a second audio signal is derived from the second sound source.

19. The system of claim 18, wherein the second audio signal is used to reduce noise in the first audio signal.

20. A system, comprising:

a plurality of microphones positioned at different locations, wherein a first microphone is part of a first device and a second microphone is part of a second device;

wherein the first device is operated to derive a first audio signal from the first microphone, the second device is operated to derive a second audio signal from the second microphone, and the second device is adapted to transmit the second audio signal to the first device; and a modification system that is part of the first device and is responsive to the first and second audio signals, wherein the modification system determines confidence scores for the first and second audio signals, and based on the confidence scores uses the second audio signal as a reference to an adaptive filter for the first audio signal, to reduce noise in the first audio signal.

21. A system, comprising:

a plurality of microphones that are part of a first device, including first and second microphones;

wherein the first device is operated to derive a first audio signal from the first microphone and a second audio signal from the second microphone; and a modification system that is part of the first device and is responsive to the first and second audio signals, wherein the modification system determines confidence scores for the first and second audio signals, and based on the confidence scores uses the second audio signal as a reference to an adaptive filter for the first audio signal, to reduce noise in the first audio signal.

22. A system, comprising:

a plurality of microphones that are part of a first device;

wherein the first device spatially focuses a plurality of its microphones on first and second separate sound sources, where a first audio signal is derived from the first sound source and a second audio signal is derived from the second sound source;

wherein the first device is operated to derive a first audio signal from the first sound source and a second audio signal from the second sound source; and a modification system that is part of the first device and is responsive to the first and second audio signals, wherein the modification system determines confidence scores for the first and second audio signals, and based on the confidence scores uses the second audio signal as a reference to an adaptive filter for the first audio signal, to reduce noise in the first audio signal.

* * * * *